United States Patent [19]

Andrews

[11] Patent Number: 4,747,857

[45] Date of Patent: May 31, 1988

[54] U-LOOP AIR HANDLING APPARATUS

[75] Inventor: John S. Andrews, Barry South Glamorgan, Wales

[73] Assignee: Strobic Air Corporation, Bensalem, Pa.

[21] Appl. No.: 79,077

[22] Filed: Jul. 29, 1987

[51] Int. Cl.[4] ..... B01D 53/00

[52] U.S. Cl. ..... 55/269; 55/276; 55/315; 55/385 R

[58] Field of Search ..... 55/269, 276, 315, 385 R, 55/481

[56] References Cited

U.S. PATENT DOCUMENTS

| | | | |
|---|---|---|---|
| 1,520,267 | 12/1924 | Waltz | 55/269 |
| 4,360,432 | 11/1982 | Kieronski | 210/402 |
| 4,617,034 | 10/1986 | Ikezaki et al. | 55/276 |
| 4,619,671 | 10/1986 | Ruff et al. | 55/269 X |

*Primary Examiner*—Charles Hart

*Attorney, Agent, or Firm*—Sperry, Zoda & Kane

[57] ABSTRACT

A U-loop air handling apparatus adapted to receive air from a surrounding environment for conditioning and channeling thereof to return ducts. The conditioning includes cooling and filtration thereof such as to be specifically usable in high technology areas requiring extremely clean working conditions. The apparatus includes a fan operatively positioned between an intake section and an output section. The intake section includes a reducing section for receiving air and passing this air through a pre-filter and a cooling coil. Condensation is removed at the cooling coil and a cross sectional area of the channel of air travel is narrowed to a smaller diameter by the reducing section. A fan box receives the conditioned air from the reducing section where it is carried through an inlet box and bell member into the fan. The fan powers the air outwardly into an acoustical box which channels the air parallel and in an opposite direction with respect to the direction of movement of the air within the intake section. The acoustical box carries the air through a damper box to prevent back flow and outwardly through a transition box to return to the environment. The various air carrying members are internally lined with acoustical insulation to minimize transmission of sound and vibration outwardly into the environment resulting from air movement or from the operation of the fan. Also the fan itself is separated vibrationally and acoustically from a portion of the intake section and a portion of the output section by flexible connecting means of rubber-like material, preferably neoprene. Further isolation is provided by independent support means being provided for the fan box and for the reducing section and for the acoustical box.

23 Claims, 2 Drawing Sheets

U-LOOP AIR HANDLING APPARATUS

BACKGROUND OF THE INVENTION

1. Field Of The Invention

The present invention deals with the field of devices for removal of air from clean room environments normally used in high technology operations and for the conditioning of that air and the return of that air to the environment. Such clean room operations are included in integrated circuit processing and fabrication as well as many other high technology activities.

This air must be removed at a very low velocity to prevent the stirring of dust or other contaminants into an airborne state adjacent to the air inlet. The low velocity removal of air must also allow filtration and cooling thereof. The air is then returned at an air return section adjacent to the air removal filter. In order to provide this structure within as small an area as possible and not make excessive use of space, it is preferable with the present invention to have the air removal and air replacement conduits located parallel with respect to one another immediately above one another with the air direction of movement in opposite directions with respect to one another.

2. Description Of The Prior Art

There are a number of devices which have been utilized for air-conditioning or the removal of smoke or paint from airborne conditions and these are shown in such patents as U.S. Pat. No. 575,877 patented Jan. 26, 1897 to H. R. Chubb on an Apparatus For Purifying Smoke Or Gas; U.S. Pat. No. 1,520,267 patented Dec. 23, 1924 to F. Waltz on a Paint Spraying Cabinet; U.S. Pat. No. 2,514,720 patented July 11, 1950 to P. Rennels on Air Conditioning; U.S. Pat. No. 3,224,175 patented Dec. 21, 1965 to G. H. Beach on an Apparatus For Separating Liquid Particle Laden Gas; U.S. Pat. No. 4,193,779 patented March 18, 1980 to D. Hencke on an Air Filtering Apparatus; U.S. Pat. No. 4,226,179 patented Oct. 7, 1980 to D. Sheldon, III on an Apparatus For Applying Sprout Inhibitor; U.S. Pat. No. 4,231,771 patented Nov. 4, 1980 to W. Winsche on Dispersoid Separation Method And Apparatus; U.S. Pat. No. 4,265,643 patented May 5, 1981 to E. Dawson on an Air Purifier; U.S. Pat. No. 4,304,224 patented Dec. 8, 1981 to R. Fortney on a Positive Environmental Enclosure; U.S. Pat. No. 4,360,432 patented Nov. 23, 1982 to J. Kieronski on a Filtering Apparatus Having Inlet Vanes For Preventing Accumulation Of Particulates; and U.S. Pat. No. 4,375,975 patented March 8, 1983 to J. McNicholas on a Centrifugal Separator.

SUMMARY OF THE INVENTION

The present invention provides a U-loop air handling apparatus which is particularly usable for the removal and handling of air from an environment such that it can be treated by cooling thereof and filtration thereof and returned to the surrounding environment.

The apparatus preferably includes a fan means having a fan inlet opening and fan outlet opening wherein the fan means is operable to receive air through the inlet for exhausting thereof through the fan outlet. An intake section is adapted to receive air for supplying thereof to the fan inlet opening of the fan means.

The intake section may include a reducing section having a reducing section output means for expelling air from the reducing section and a reducing section input area for receiving low velocity air from the treated environment. Preferably the reducing section will have a reducing section output means which is smaller than the cross sectional reducing section input means to insure low velocity removal of air from the surrounding environment. A cooling means may be positioned within the reducing section to lower the temperature of air moving therethrough. Furthermore, a filtration means may be positioned within the reducing section to remove contaminants from the air moving therethrough. Preferably this filtering means will extend across the reducing section input area to act as a pre-filter.

A first flexible connecting member preferably is formed of a flexible resilient material and is secured with respect to the reducing section output means. A fan box means includes a box inlet means and a box outlet means. The box outlet is secured with respect to the fan inlet opening and the box inlet means is secured with respect to the first flexible connecting means to acoustically and vibrationally isolate the reducing section with respect to the fan box. A bell means is included having a bell inlet and a bell outlet. The bell outlet is of the smaller cross sectional area than the bell inlet to facilitate the flow of air. The bell inlet is attached with respect to the box outlet to receive air flow therefrom. The bell outlet means is secured with respect to the fan inlet opening to supply air flow therethrough. Preferably the bell outlet is positioned above the bell inlet and the bell means is gradually upwardly and inwardly tapered therefrom to form a bell-shaped bell means.

An intake section mounting means is secured with respect to the intake section and is adapted to resiliently secure the intake section with respect to the surrounding environmental structure.

An output section is adapted to receive conditioned air from the fan outlet opening for expelling this air from the U-loop handling apparatus into the treated environment. The outlet section may include a second flexible connector attached with respect to the fan outlet opening. An acoustical box means may also be included including an acoustical box inlet means and an acoustical box outlet means. The acoustical box inlet means is attached with respect to the second flexible connector to acoustically and vibrationally isolate the fan means therefrom. A damper box may be positioned with respect to the acoustical outlet means to prevent the back flow of air therethrough. Preferably this damper box will include damper plates therein to facilitate the prevention of back flow of air therethrough.

An outlet transition box may include a transition inlet means and a transition outlet means with the transition inlet means being attached with respect to the damper box to receive conditioned air therefrom. The transition outlet means is adapted to supply conditioned air directly to the treated environment. An output section mounting means may also be secured with respect to the output section and be adapted to resiliently secure the output section with respect to the surrounding environmental structure.

Preferably the U-loop air handling apparatus of the present invention will be in a general configuration with the output section positioned above the intake section and having a general direction of air flow parallel but in an opposite direction with respect to one another. In this manner air will be removed through the lower intake section with the fan means directing the air upwardly at the opposite end thereof into an output section which is directed parallel and opposite with respect to the intake section to re-admit the air into the surrounding environmental structure. Preferably this configuration is made possible by the fan box outlet means being oriented at approximately 90 degrees with respect to the fan box inlet to thereby change the direction of movement of air entering therein from a horizontal direction to a vertical direction or entering the bell means and the fan means in such a manner as to be expelled into the acoustical box means.

Preferably the fan box defines an access opening therein to facilitate access to the interior thereof. The fan box means may further include an access door capable of extending across the access opening to selectively open and close this access opening. To facilitate movement of the access door between the opened and closed position, the fan box means may include an access door handle fixedly secured with respect to the access door.

The cooling means located within the reducing section preferably will comprise a cooling coil which may carry a cooling fluid therein such as water. With this configuration it is preferable also to include a condensation pan immediately below the cooling means such that humidity removed from the air upon cooling thereof will be capable of being collected in an orderly manner. Removal of collected water from the condensate pan is possible through a drain means defined therein.

Preferably the air carrying members of the handling apparatus of the present invention will include acoustical insulation means extending about the interior walls thereof. In particular such acoustical insulation means should be included preferably on the interiors of the acoustical box, fan box, reducing section, bell means, and output transition box.

The input section mounting means preferably comprises two separate elements. The first mounting means will be provided by resilient pad means which can be made of neoprene-type material positioned beneath the reducing section. Another mounting means defined within the input section mounting means may preferably comprise the input spring mounting means being directly securable with respect to the bottom portion of the fan box means. The output section mounting means preferably may include an output spring mounting means positioned above and secured with respect to the acoustical box in order for suspension thereof from environmental structure located thereabove.

Preferably the acoustical insulation means located about the interior walls of the air carrying elements of the present invention will be formed of a long-fibre non-hydroscopic material.

It is an object of the present invention to provide a U-loop air handling apparatus being particularly capable for handling and conditioning air removed for treatment from a clean environment wherein undesirable moisture is removed from the air.

It is an object of the present invention to provide a U-loop air handling apparatus being particularly capable for handling and conditioning air removed for treatment from a clean environment wherein the air is filtered immediately upon being drawn into the air handling apparatus.

It is an object of the present invention to provide a U-loop air handling apparatus being particularly capable for handling and conditioning air removed for treatment from a clean environment wherein condensed air is guided within a condensation pan located immediately below the cooling means.

It is an object of the present invention to provide a U-loop air handling apparatus being particularly capable for handling and conditioning air removed for treatment from a clean environment wherein removal of water from the condensate pan is made possible by a drain pump.

It is an object of the present invention to provide a U-loop air handling apparatus being particularly capable for handling and conditioning air removed for treatment from a clean environment wherein air is removed from the surrounding environment at a very low velocity made possible by a reducing section with the air handling apparatus.

It is an object of the present invention to provide a U-loop air handling apparatus being particularly capable for handling and conditioning air removed for treatment from a clean environment wherein the fan or blower means is acoustically and vibrationally isolated from the conduits for removing air from the environment as well as from the conduits for re-supplying air to the environment.

It is an object of the present invention to provide a U-loop air handling apparatus being particularly capable for handling and conditioning air removed for treatment from a clean environment wherein independent mounting means are provided for securing the intake section and the output section with respect to the surrounding environment.

It is an object of the present invention to provide a U-loop air handling apparatus being particularly capable for handling and conditioning air removed for treatment from a clean environment wherein the output section re-supplies air to the surrounding environment in the direction parallel to the movement of air through the intake section and in an opposite direction with respect thereto.

It is an object of the present invention to provide a U-loop air handling apparatus being particularly capable of handling and conditioning air removed for treatment from a clean environment wherein back flow of air through the output section is prevented by a damper box including damper plates located therein.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
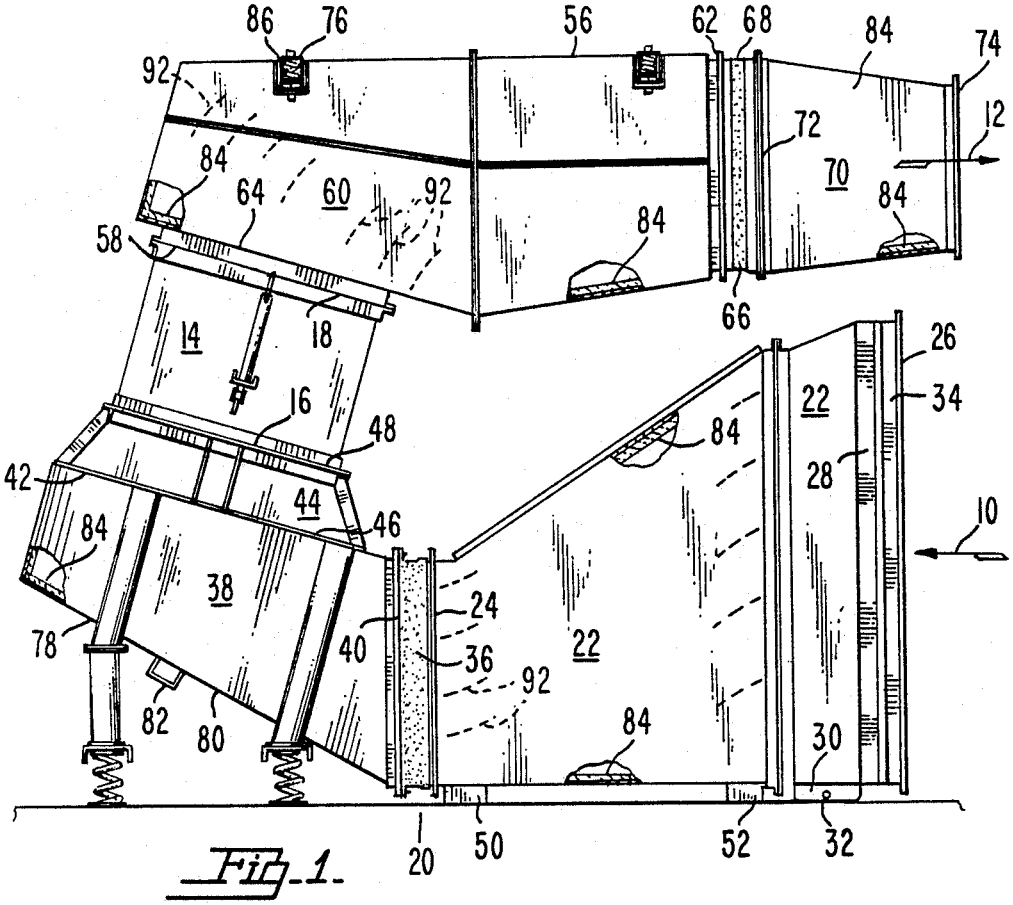
FIG. 1 is a front plan view of an embodiment of the U-loop air handling apparatus of the present invention.

The present invention provides a U-loop air handling apparatus for the removal of incoming air 10 of low velocity from a treated environment with the resulting exhausting of treated area 12 back into the surrounding environment. Movement of the air is made possible by a blower or fan means 14 which is acoustically and vibrationally separated from the treated environment.

Fan means 14 includes a fan inlet opening 16 and a fan outlet opening 18 such that air is caused to enter through fan inlet opening 16 responsive to operation of fan means 14 with the exhausting of air outwardly through fan outlet opening 18.

An intake section 20 is positioned adjacent to the fan inlet opening 16 and is positioned adjacent to the treated environment to remove air therefrom for supplying to the fan means 14. Intake section 20 may include a reducing section 22 comprising a reducing section output means 24 and a reducing section input means 26. Upon operation of the fan means air is drawn inwardly through the reducing section input means 26. In view of the reducing aspect of the reducing section 22 the incoming air 10 is at a very low velocity.

Preferably a filter means 34 such as a pre-filter member extends across the reducing section input means 26 for the filtering of air prior to movement further into the reducing section 22.

Immediately after filtration the reducing section 22 includes a cooling means 28 preferably in the form of a coil for the cooling of the filtered air. A condensate pan 30 is preferably positioned immediately below the cooling means 28 for the collecting of condensed water vapor therein. Condensate pan 30 preferably includes a drain means 32 to facilitate removal of collected water therefrom.

A first flexible connecting means 36 is secured with respect to the reducing section output means 24 to vibrationally and acoustically isolate the reducing section 22 with respect to the further downstream components. A fan box means 38 is defined including a box inlet means 40 secured with respect to the first flexible connecting means 36. Fan box means 38 also defines a box outlet means 42 which is preferably oriented to move air approximately 90 degrees with respect to the direction of movement of air as it passes through the box inlet means 40.

Bell means 44 is positioned adjacent the fan box 38 and includes a bell inlet means 46 and a bell outlet means 48. Bell inlet means 46 is preferably secured with respect to the box outlet means 42 and the bell outlet means 48 is preferably secured with respect to the fan inlet opening 16. In this manner air passing through the fan box 38 in a horizontal direction is caused to move upwardly for vertical movement by exiting through the box outlet means 42. This air will then enter through the bell inlet means 46 and be urged to move upwardly through the bell outlet means 48 into the fan means 14 for blowing vertically therefrom.

To facilitate mounting of the intake section with respect to the surrounding environment an intake mounting means 50 is included. This intake section mounting means 50 may preferably include a plurality of resilient pad means of neoprene or other resilient material positioned below the reducing section. Furthermore the intake section mounting means may include input spring mounting means for spring mounting of the fan box means with respect to the environmental structure therebelow. Separate mounting means are required for the reducing section and the fan box means due to the fact that they are acoustically and vibrationally isolated with respect to one another by the positioning of the first flexible connecting means therebetween.

An output section 56 may be included having initially a second flexible connecting means 58 positioned secured with respect to the fan outlet opening 18.

An acoustical box means 60 is secured with respect to the second flexible connecting means and includes an acoustical box outlet means 62 and an acoustical box inlet means 64. The acoustical box inlet means 64 is the portion which is secured with respect to the second flexible connecting means 58. The acoustical box outlet means is preferably secured with respect to a damper box 66. Damper box 66 may be positioned at any location within the output section 56. As shown in the drawings damper box 66 is positioned between acoustical box means 60 and output transition box 70. Alternatively the damper box 66 could be positioned at any location within either of these two sections or at the output of the fan means. The resulting structure should be such that the damper box prevents back flow of air to the location of fan means 14. Damper box 66 preferably includes damper plates 68 therein to prevent back flow of air through the output section 56.

Conditioned air passing through the damper box 66 is then received by the output transition box 70. The box 70 may include a transition inlet 72 and a transition outlet 74. Transition inlet 72 is secured with respect to the damper box 66 and transition outlet 74 is the ultimate exhausting location for conditioned air for return to the surrounding environment.

Preferably the output section includes a mounting means 76 in the form of an output spring mounting means 86. Preferably this spring mounting means 86 will be secured with respect to the upper portion of the acoustical box means for suspension thereof with respect to environmental structure located thereabove.

Preferably the fan box means may include an access opening 78 defined thereon with an access door 80 selectively positionable to close the access opening 78. Movement of the access door 80 between the opened and closed position is facilitated by an access handle 82.

It is preferable that most air carrying elements of the present invention include acoustical insulation means 84 extending about the interior surface thereof. This acoustical insulation means 84 should be located within the acoustical box means, transition outlet means, bell means, fan box means and reducing section.

The use of this insulation in combination with the isolation of the fan means 14 by way of separate mounting means and the usage of the first and second flexible connecting means 36 and 58 will greatly enhance the acoustical and vibrational isolation of the fan means with respect to the environment to which the air is exhausted. The fan means 14 and the fan box 38 are one unit which is independently mounted by mounting means 54 and is separated from a portion of the intake section 20 and a portion of the output section 56 by the first and second flexible connecting means 36 and 58. This novel arrangement of independent mounting means for three independent sections in combination with the overall U-loop design of the present invention wherein withdrawn incoming air 10 and treated air 12 move in parallel but opposite positions provides an the novel overall configuration of the present invention.

To facilitate the guiding of air through the intake section 20 or the output section 56, attenuation means 90 may be included positioned therein. These attenuators can be multi-celled walls within the air carrying section which facilitate the non-turbulent flow of air therethrough. Also in areas where air is forced around a corner it is possible to include turning veins 92. These walls are preferably arcuate and will facilitate the gentle guiding of air movement about angles necessarily required by the 180 degree shift in direction of movement of air between the intake section and the output section.

Figure 2:
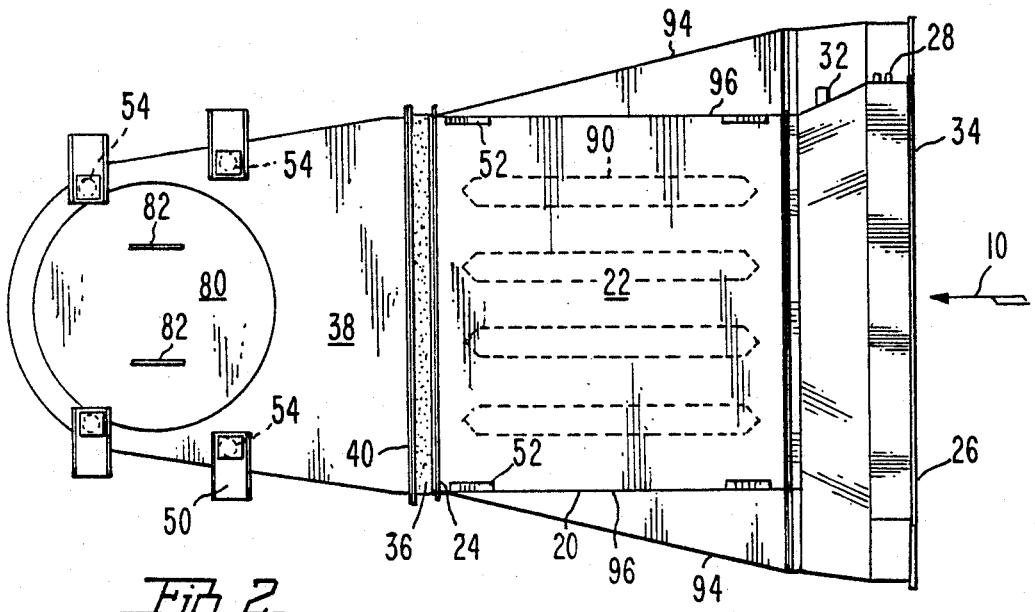
FIG. 2 is a bottom plan view of an embodiment of the configuration shown in FIG. 1.
Figure 3:
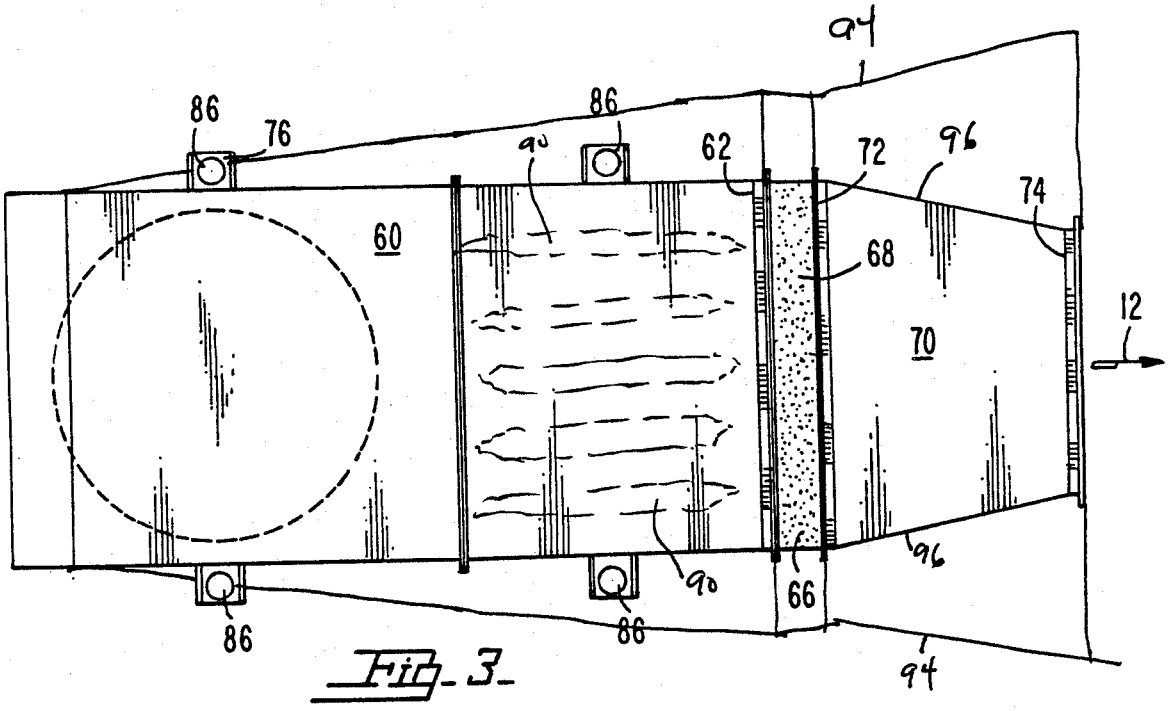
FIG. 3 is a top plan view of the embodiment of the present invention shown in FIG. 1.

The shape of the individual segments of the intake section and the output section can be of varied configuration. However within the reduction section 22, some amount of reduction in the cross-section of the airflow path is required. The reduction may be somewhat continuously gradual as shown on outer walls 94 or may be segmented sections of reduction as shown by inner walls 96. Either of these two wall configurations as shown in FIGS. 2 and 3 can be used.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A U-loop air handling apparatus, for handling and conditioning air from an environment to be treated, comprising:

(a) a fan means including a fan inlet opening and a fan outlet opening, said fan means being operable to receive air through said fan inlet opening for exhausting thereof through said fan outlet opening;

(b) an intake section adapted to receive air for supplying thereof to said fan inlet opening of said fan means, said intake section comprising:

(1) a reducing section comprising:

(a) a reducing section output means for expelling air from said reducing section;

(b) a reducing section input means for receiving low velocity air from the treated environment, said reducing section output means being of smaller cross-sectional area than said reducing section input means;

(c) a cooling means positioned within said reducing section to lower the temperature of air moving therethrough;

(d) a filter means positioned within said reducing section to remove contaminants from the air moving therethrough;

(2) a first flexible connecting means of flexibly resilient material secured with respect to said reducing section output means;

(3) a fan box means including a box inlet means and a box outlet means, said box outlet being secured with respect to said fan inlet opening, said box inlet means being secured with respect to said first flexible connecting means to acoustically and vibrationally isolate said reducing section from said fan box means;

(4) a bell means including a bell inlet means and a bell outlet means, said bell outlet means being of a smaller cross-sectional area than said bell inlet means to facilitate flow of air, said bell inlet means being attached with respect to said box outlet means to receive air flow therefrom, said bell outlet means being secured with respect to said fan inlet opening to supply air flow thereto;

(5) an intake section mounting means secured with respect to said intake section and adapted to resiliently secure said intake section with respect to the surrounding environmental structure;

(c) an output section adapted to receive conditioned air from said fan outlet opening for expelling same from the U-loop handling apparatus into the treated environment, said outlet section comprising:

(1) a second flexible connector means attached with respect to said fan outlet opening;

(2) an acoustical box means including an acoustical box inlet means and an acoustical box outlet means, said acoustical box inlet means being attached with respect to said second flexible connector means to acoustically and vibrationally isolate said fan means therefrom;

(3) an output transition box including a transition inlet means and a transition outlet means, said transition inlet means being attached with respect to said acoustical box outlet means to receive conditioned air therefrom, said transition outlet means being adapted to supply conditioned air directly to the treated environment;

(4) an output section mounting means secured with respect to said output section and adapted to resiliently secure said output section with respect to the surrounding environmental structure; and (5) a damper box positioned within said output section and extending across the path of air flow therethrough to prevent backflow of air therein.

2. The U-loop air handling apparatus as defined in claim 1 wherein said output section extends generally parallel with respect to said intake section with the path of air travel being in the opposite direction with respect to one another.

3. The U-loop air handling apparatus as defined in claim 2 wherein said fan means is oriented generally vertically to move air upwardly from said bell outlet means to said second flexible connecting means.

4. The U-loop air handling apparatus as defined in claim 3 wherein said fan box outlet means is oriented at approximately 90 degrees with respect to said fan box inlet means to change the direction of movement of air entering therein from horizontal to vertical for entering said bell means.

5. The U-loop air handling apparatus as defined in claim 1 wherein said fan box means defines an access opening defined therein to facilitate access to the interior thereof, said fan box means further including an access door extending over said access opening to selectively open and close said access opening.

6. The U-loop air handling apparatus as defined in claim 5 wherein said fan box means further includes an access door handle to facilitate movement of said access door between the open and closed positions.

7. The U-loop air handling apparatus as defined in claim 1 wherein said bell means extends from sid bell inlet means upwardly and inwardly toward said bell outlet means.

8. The U-loop air handling apparatus as defined in claim 1 wherein said filter means comprises a pre-filter means extending across said reducing section inlet means to filter air prior to entry into said reducing section.

9. The U-loop air handling apparatus as defined in claim 1 wherein said cooling means comprises a cooling-coil means including cooling fluid carried therein and extending across said reducing section to cool air traveling therethrough.

10. The U-loop air handling apparatus as defined in claim 9 wherein said cooling fluid comprises water.

11. The U-loop air handling apparatus as defined in claim 9 wherein said cooling fluid comprises DX fluid.

12. The U-loop air handling apparatus as defined in claim 1 wherein said reducing section includes a condensate pan located therein below said cooling means to collect condensed water vapor from the cool air traveling therethrough.

13. The U-loop air handling apparatus as defined in claim 1 wherein said acoustical box includes acoustical insulation means extending about the interior walls thereof to minimize sound transmission to the surrounding environment.

14. The U-loop air handling apparatus as defined in claim 13 wherein said fan box means, said reducing section, said bell means and said output transition box each include acoustical insulation means extending about the interior walls thereof to minimize sound transmission to the surrounding environment.

15. The U-loop air handling apparatus as defined in claim 1 wherein said backdraft damper includes damper plates to enhance backdraft damping.

16. The U-loop air handling apparatus as defined in claim 1 wherein said input section mounting means includes resilient pad means positioned beneath said reducing section.

17. The U-loop air handling apparatus as defined in claim 1 wherein said input section mounting means includes input spring mounting means positioned beneath said fan box means.

18. The U-loop air handling apparatus as defined in claim 1 wherein said output section mounting means includes output spring mounting means positioned above said acoustical box means for suspending same from the surrounding environmental structure.

19. The U-loop air handling apparatus as defined in claim 1 wherein said first flexible connecting means is of rubber-like material.

20. The U-loop air handling apparatus as defined in claim 1 wherein said second flexible connecting means is of rubber-like material.

21. The U-loop air handling apparatus as defined in claim 12 wherein said condensate pan includes a drain means therein to facilitate removal of collected water therefrom.

22. The U-loop air handling apparatus as defined in claim 14 wherein said acoustical insulation means comprises a long-fiber non-hydroscopic material.

23. A U-loop air handling apparatus, for handling and conditioning air from an environment to be treated, comprising:

(a) a fan means including a fan inlet opening and a fan outlet opening, said fan means being operable to receive air through said fan inlet opening for exhausting thereof through said fan outlet opening;

(b) an intake section adapted to receive air for supplying thereof to said fan inlet opening of said fan means, said intake section extending generally horizontally, said intake section comprising:

(1) a reducing section comprising:

(a) a reducing section output means for expelling air from said reducing section;

(b) a reducing section inlet means for receiving low velocity air from the treated environment, said reducing section output means being of smaller cross-sectional area than said reducing section inlet means;

(c) a cooling coil means positioned within said reducing section to lower the temperature of air moving therethrough, said cooling coil means adapted to carry cooling fluid therein;

(d) a condensate pan located below said cooling coil means to collect condensed water vapor therefrom, said condensate pan including a drain means defined therein to facilitate removal of collected water vapor therefrom;

(e) a pre-filter means extending across said reducing section inlet means to remove contaminants from air prior to entering said reducing section;

(f) acoustical insulation means extending about the interior of said reducing section to minimize sound transmission to the surrounding environment;

(2) a first flexible connecting means of flexibly resilient material secured with respect to said reducing section output means, said first flexible connector means being made of rubber-like material;

(3) a fan box including a box inlet means and a box outlet means, said box outlet means being oriented at approximately 90 degrees with respect to said box inlet means to expel air from said fan box means upwardly therefrom, said box outlet being secured with respect to said fan inlet opening, said box inlet means being secured with respect to said first flexible connecting means to acoustically and vibrationally isolate said reducing section from said fan box means, said fan box means further including acoustical insulation means extending about the interior thereof to minimize sound transmission to the surrounding environment, said fan box means defining an access opening therein to facilitate access to the interior thereof, said fan box means further including:

(a) an access door extending across said access opening and adapted to be movable between a closed position extending thereacross and an open position spaced therefrom;

(b) an access handle means attached with respect to said access door to facilitate movement thereof between the closed position and the open position;

(4) a bell means including a bell inlet means and a bell outlet means, said bell outlet means being of a smaller cross-sectional area than said bell inlet means to facilitate flow of air, said bell means extending upwardly and inwardly from said bell inlet means to said bell outlet means, said bell inlet means being attached with respect to said box outlet means to receive air flow therefrom, said bell outlet means being secured with respect to said fan inlet opening to supply air flow thereto, said bell means further including acoustical insulation means extending about the interior thereof to minimize sound transmission to the surrounding environment;

(5) an intake section mounting means secured with respect to said intake section and adapted to resiliently secure said intake section with respect to the surrounding environmental structure, said intake section mounting means further comprising:

(a) resilient pad means positioned beneath said reducing section;

(b) input spring mounting means positioned beneath said fan box means;

(c) an output section adapted to receive conditioned air from said fan outlet opening for expelling same from the U-loop handling apparatus into the treated environment, said output section extending generally horizontally parallel to said intake section with the air traveling therein the opposite direction with respect thereto, said outlet section comprising:

(1) a second flexible connector means attached with respect to said fan outlet opening, said second flexible connector means being made of rubber-like material;

(2) an acoustical box means including an acoustical box inlet means and an acoustical box outlet means, said acoustical box inlet means being attached with respect to said second flexible connector means to acoustically and vibrationally isolate said fan means therefrom, said acoustical box means further including acoustical insulation means extending about the interior thereof to minimize sound transmission to the surrounding environment;

(3) a damper box attached with respect to said acoustical box outlet means to prevent back flow of air therethrough, said damper box including damper plates to facilitate backdraft damping;

(4) an output transition box including a transition inlet and a transition outlet, said transition inlet being attached with respect to said damper box to receive condition air therefrom, said transition outlet being adapted to supply conditioned air directly to the treated environment, said output transition box further including acoustical insulation means extending about the interior thereof to minimize sound transmission to the surrounding environment; and (5) an output section mounting means secured with respect to said output section and adapted to resiliently secure said output section with respect to the surrounding environmental structure, said output section mounting means including output spring mounting means positioned above said acoustical box means for suspending same from the surrounding environmental structure.

* * * * *